US010865984B1

(12) United States Patent
Edens

(10) Patent No.: US 10,865,984 B1
(45) Date of Patent: Dec. 15, 2020

(54) EFFICIENT BURNER FOR YARD WASTE AND DOCUMENTS

(71) Applicant: Henry A. Edens, Yorktown, VA (US)

(72) Inventor: Henry A. Edens, Yorktown, VA (US)

( * ) Notice: Subject to any disclaimer, the term of this patent is extended or adjusted under 35 U.S.C. 154(b) by 0 days.

(21) Appl. No.: 16/944,858

(22) Filed: Jul. 31, 2020

(51) Int. Cl.
*F23G 5/24* (2006.01)
*F23G 5/44* (2006.01)

(52) U.S. Cl.
CPC ..... *F23G 5/24* (2013.01); *F23G 5/44* (2013.01); *F23G 2200/00* (2013.01); *F23G 2203/403* (2013.01)

(58) Field of Classification Search
CPC ..... F23G 5/24; F23G 2203/403
See application file for complete search history.

(56) References Cited

U.S. PATENT DOCUMENTS 1,349,785 A * 8/1920 Savage ..... F23G 5/12 110/253
1,648,119 A * 11/1927 Hallett ..... F23G 5/10 110/250
3,111,097 A * 11/1963 Dodge ..... F23G 5/40 110/240
4,200,086 A * 4/1980 Kolb ..... F24B 9/00 126/66
4,377,153 A * 3/1983 Flagg ..... F23M 9/00 126/502
D576,833 S * 9/2008 Mansell ..... D7/332
D755,557 S * 5/2016 Stout ..... D7/332
D820,021 S * 6/2018 Henderson ..... D7/332
2018/0317706 A1* 11/2018 Graves ..... A23L 5/10

* cited by examiner

*Primary Examiner* — David J Laux
(74) *Attorney, Agent, or Firm* — Peter J. Van Bergen

(57) ABSTRACT

A nonflammable burner includes a can with holes in its sidewalls and bottom. Hollow legs are coupled to the bottom of the can. Each hollow leg has an open end in fluid communication with an interior of the can with perforations in each hollow leg providing fluid communication with an interior of the hollow leg such that each hollow leg provides fluid communication between an ambient environment and the interior of the can. A tray is positioned on a ground surface and engages with the hollow legs wherein the bottom of the can is spaced apart from the tray. Open-ended conduits extend between the sidewalls of the can to provide a fluid flow path there through. Each conduit admits the ambient environment therein, and includes perforations for providing fluid communication between the fluid flow path and the interior of the can.

25 Claims, 4 Drawing Sheets

EFFICIENT BURNER FOR YARD WASTE AND DOCUMENTS

FIELD OF THE INVENTION

The invention relates generally to the burning of yard waste and documents, and more particularly to a nonflammable burner for the efficient and safe burning of yard waste and paper documents at an outside location.

BACKGROUND OF THE INVENTION

Outdoor burning of yard and garden debris is a common way for homeowners to dispose of such debris. Good, clean burning of such materials reduces the volume thereof immensely as the resulting ash is easily worked back into the local soil. Ideally, burning of yard debris occurs quickly and with minimal smoldering to reduce smoke levels. Further, safety concerns dictate that outside burning be contained in small areas to prevent the fire from getting out of control or spreading to surrounding areas and/or structures.

In addition to routinely dealing with the disposal of yard debris, today's homeowners are faced with periodic destruction and disposal of documents that contain sensitive personal information, e.g., social security numbers, account numbers, personal medical information, tax information, etc. Currently, personal documents are generally shredded to dispose of these materials safely. However, the use of personal shredding devices is a time consuming and tedious process. One costly alternative is to take one's documents to a commercial shredding business. While, burning of one's personal documents is another alternative, the burning of documents is prone to generating smoldering and smoking fires since the flat-pack nature documents provides minimal air between documents.

SUMMARY OF THE INVENTION

Accordingly, it is an object of the present invention to provide a burner.

Another object of the present invention is to provide a burner that is configured to safely, quickly, and cleanly burn yard debris or documents.

Still another object of the present invention is to provide a burner configured for ready placement in a yard.

Other objects and advantages of the present invention will become more obvious hereinafter in the specification and drawings.

In accordance with the present invention, a nonflammable burner includes a can having an open top, sidewalls, and a bottom. The can has holes in its sidewalls and bottom. A plurality of hollow legs is coupled to the bottom of the can. Each hollow leg has an open end in fluid communication with an interior of the can. Perforations in each hollow leg provide fluid communication with an interior of the hollow leg such that each hollow leg provides fluid communication between an ambient environment and the interior of the can. A tray is positioned on a ground surface and engages with the hollow legs wherein the bottom of the can is spaced apart from the tray. A plurality of open-ended conduits extend between the sidewalls of the can and provide a fluid flow path there through. Each conduit admits the ambient environment therein, and includes perforations for providing fluid communication between the fluid flow path and the interior of the can.

BRIEF DESCRIPTION OF THE DRAWINGS

Other objects, features and advantages of the present invention will become apparent upon reference to the following description of the preferred embodiments and to the drawings, wherein corresponding reference characters indicate corresponding parts throughout the several views of the drawings and wherein.

DETAILED DESCRIPTION OF THE INVENTION

Figure 1:
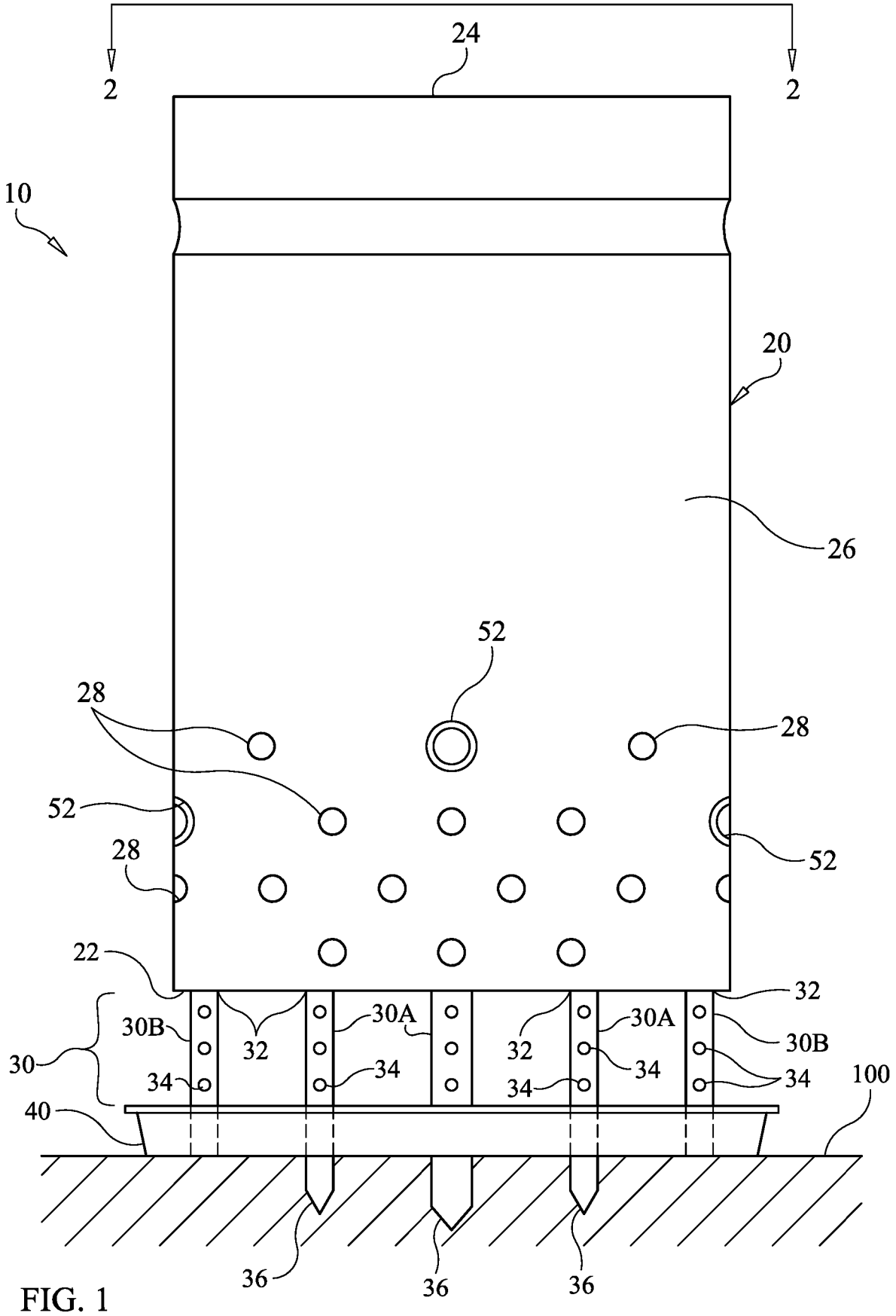
FIG. 1 is a side view of a burner in accordance with an embodiment of the present invention.

Referring now to the drawings, simultaneous reference will be made to FIGS. 1 and 2 where a burner in accordance with an embodiment of the present invention is shown and is referenced generally by numeral 10. In general, burner 10 is made from nonflammable materials and provides for quick and clean burning of yard debris as well as papers/documents that can be deposited into burner 10 in flat stacks. As will be described further below, burner 10 is configured for quick and safe placement in a yard environment to provide a homeowner with a safe and inexpensive solution for yard and document disposal.

Burner 10 includes a can 20, a group of hollow legs 30 coupled to can 20, a stabilizing ash tray 40 engaged with legs 30, and air admitting conduits 50 (visible in FIG. 2) extending across can 20. Can 20 has a bottom 22, is open at its top 24, and has sidewalls 26 extending from bottom 22 open top 24. Can 20 is generally rigid structure such as a metal trash can. A number of holes 28 are provided through the lower half of sidewalls 26 (FIG. 1) and bottom 22 (FIG. 2).

Each of hollow legs 30 can be a rigid metal pipe having an end 32 (FIG. 2) coupled to bottom 22. Each end 32 is open to provide fluid communication between the interior of each of legs 30 and the interior of can 20 just above bottom 22. Each leg 30 has a number of perforations 34 such that ambient air is in fluid communication with the interior of legs 30. As a result, each of hollow legs 30 provides fluid communication between ambient air and the interior of can 20 just above bottom 22.

Legs 30 also provide the support for can 20 above a ground surface 100. Briefly, the group of legs 30 engage with tray 40 that rests on ground surface 100 so that bottom 22 of can 20 is spaced apart from tray 40. In the illustrated embodiment, the group of hollow legs 30 includes legs 30A and legs 30B where the length of legs 30A is greater than the length of legs 30B. More specifically, longer legs 30A pass through tray 40 to engage a ground region beneath ground surface 100, while shorter legs 30B rest on tray 40. Each of longer legs 30A can be tipped with a spike 36 that can be attached to or integrated with the ends of longer legs 30A without departing from the scope of the present invention.

As mentioned above, tray 40 is generally a rigid (metal) tray that serves as the base support for can 20 as it engages with the group of hollow legs 30 and rests on ground surface 100. Tray 40 can be rigidly coupled to the group of hollow legs 30. Tray 40 could also have holes (not shown) provided therein for loose engagement with longer legs 30A, while shorter legs 30B simply rest on a solid portion of a tray 40. In general, there are at least two longer legs 30A and at least two shorter legs 30B distributed about bottom 22 such that can 20 can be supported in a balanced fashion. Additional longer legs 30A and/or shorter legs 30B can be provided without departing from the scope of the present invention.

Figure 2:
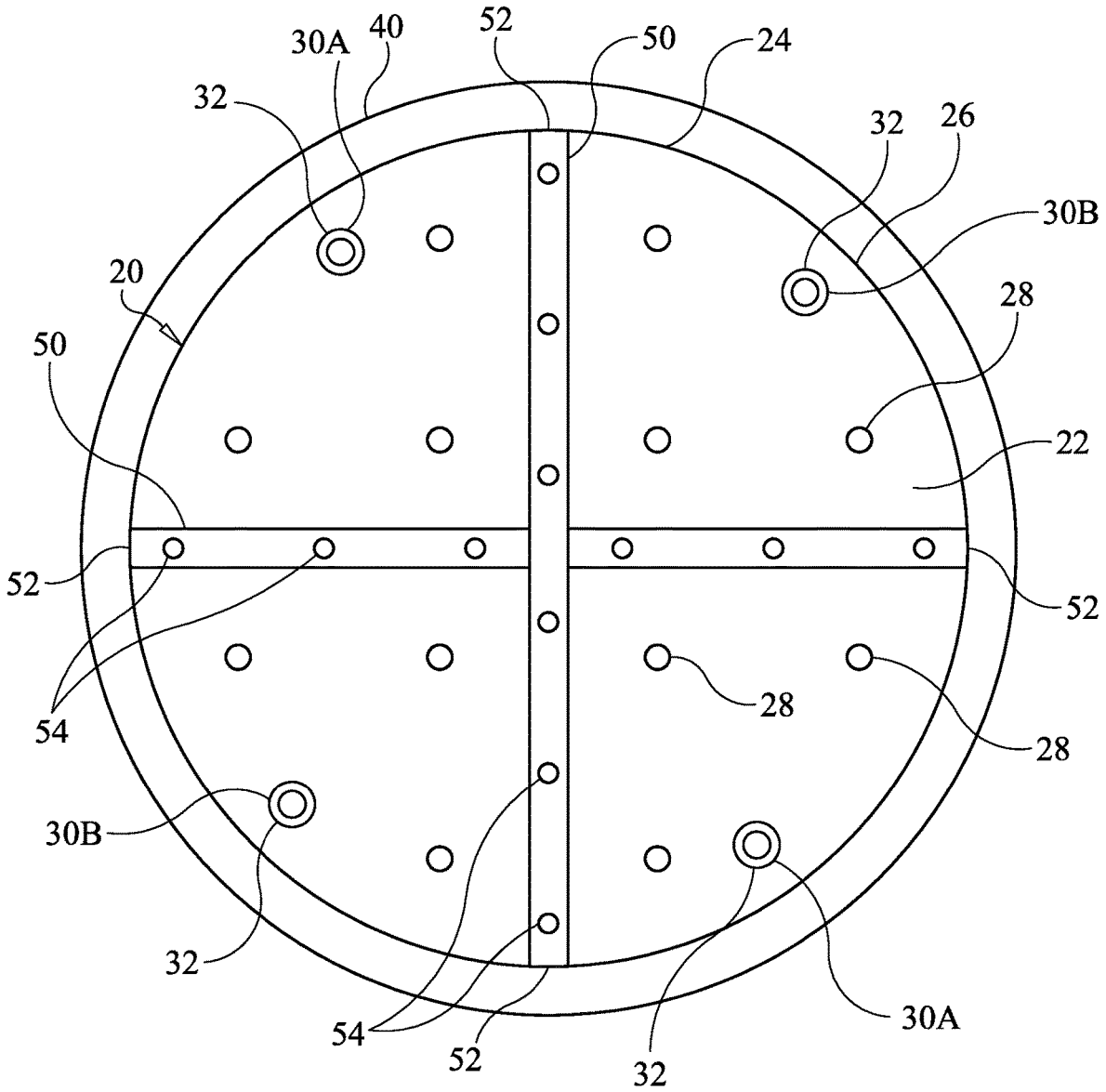
FIG. 2 is a top view of the burner taken along line 2-2 in FIG. 1 illustrating the interior of the burner in accordance with an embodiment of the present invention.
Figure 3:
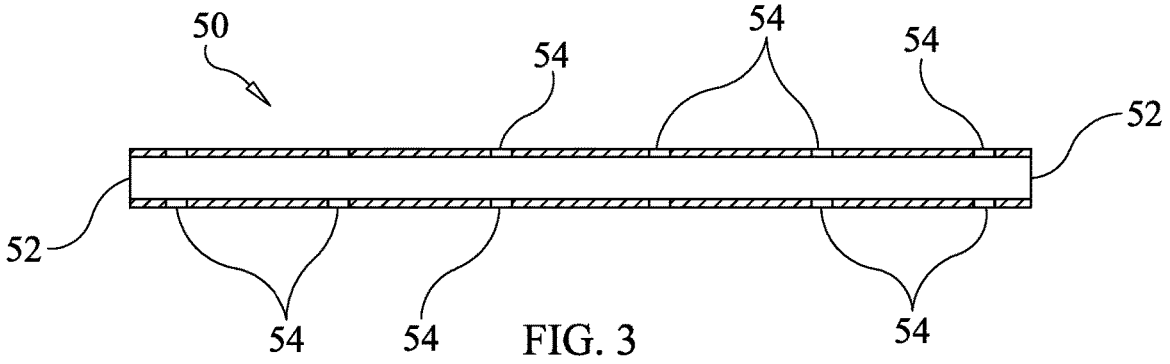
FIG. 3 is an isolated cross-sectional view of one of the air-admitting conduits extending across the burner in accordance with an embodiment of the present invention.

As shown in FIG. 2, burner 10 includes a number of air admitting conduits 50 extending across can 20. For example, each of conduits 50 can extend across a unique diameter of can 20 at a unique height within can 20. Conduits 50 could also extend across chords of can 20 or be curved as they traverse can 20 without departing from the scope of the present invention. Generally, conduits 50 are disposed in the lower half of can 50. Both ends 52 of each conduit 50 are open to define a fluid flow path through the conduit. Ends 52 for each conduit are coupled to sidewalls 26 of can 20 such that ambient air can flow into each open end 52. Each conduit 50 also includes perforations 54 along the length thereof such that ambient air is in fluid ammunition with the interior of can 20 via open ends 52 and perforations 54. As shown in FIG. 3, perforations 54 can be provided at multiple circumferential positions on conduits 50, e.g., on top and bottom of each conduit. Two or more conduits 50 can be used in burner 10, and they could be located at different heights in can 20 or arranged in a particular fashion (e.g., pyramid arrangement) to define a burn zone within can 20.

In operation, once a user has positioned burner 10 on a ground surface 100 as shown, a small amount of debris/documents can be deposited in can 20 and a fire can be started therein with a burn zone residing in the lower half of can 20. As soon as fire starts, ambient air is drawn into the lower half interior of can 20 via holes 28 in bottom 22 and sidewalls 26, the group of hollow legs 30, and conduits 50. The introduction of ambient air from beneath the burn zone, from the sides of the burn zone, and in the center of the burn zone of the lower half of can 20 is a catalyst for quick and clean burning of any material deposited into can 20. The hot burn zone is maintained in the lower half of can 20 for safety. The circulation of ambient air into the burn zone also serves to separate debris/documents deposited into the can to provide the needed air thereabout for a quick and clean burn. The resulting clean burning of material reduces the amount of generated ash which falls safely through holes 28 in bottom 22 for deposition onto nonflammable tray 40.

Figure 4:
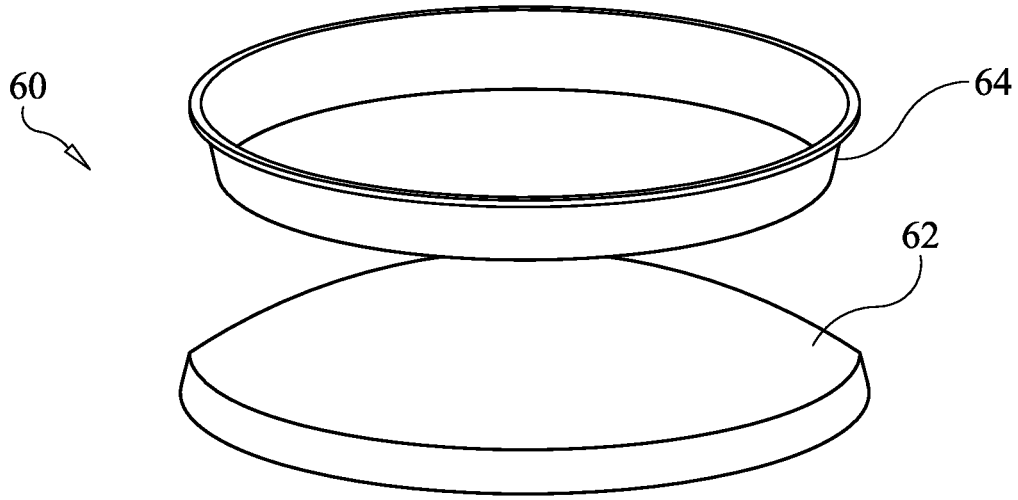
FIG. 4 is a perspective view of a lid for the open top of the burner in accordance with an embodiment of the present invention.

The present invention can be placed in a safe location in a yard environment. When not being used for burn activities, the burner can be covered with a lid. In accordance with another embodiment of the present invention, a lid for can 20 can provide additional utility. For example, FIG. 4 illustrates a lid 60 for can 20 that includes a can covering portion 62 and an open-top receptacle portion 64. If can 20 is a metal trash can, each of portions 62 and 64 could be conventional trash can lid portions 62 and 64 that are joined at their tops to simultaneously to define a can-covering lid and open-top receptacle when placed on can 20. The open-top receptacle portion 64 can then serve as a bird bath or bird feeder, a shallow planter, etc.

Figure 5:
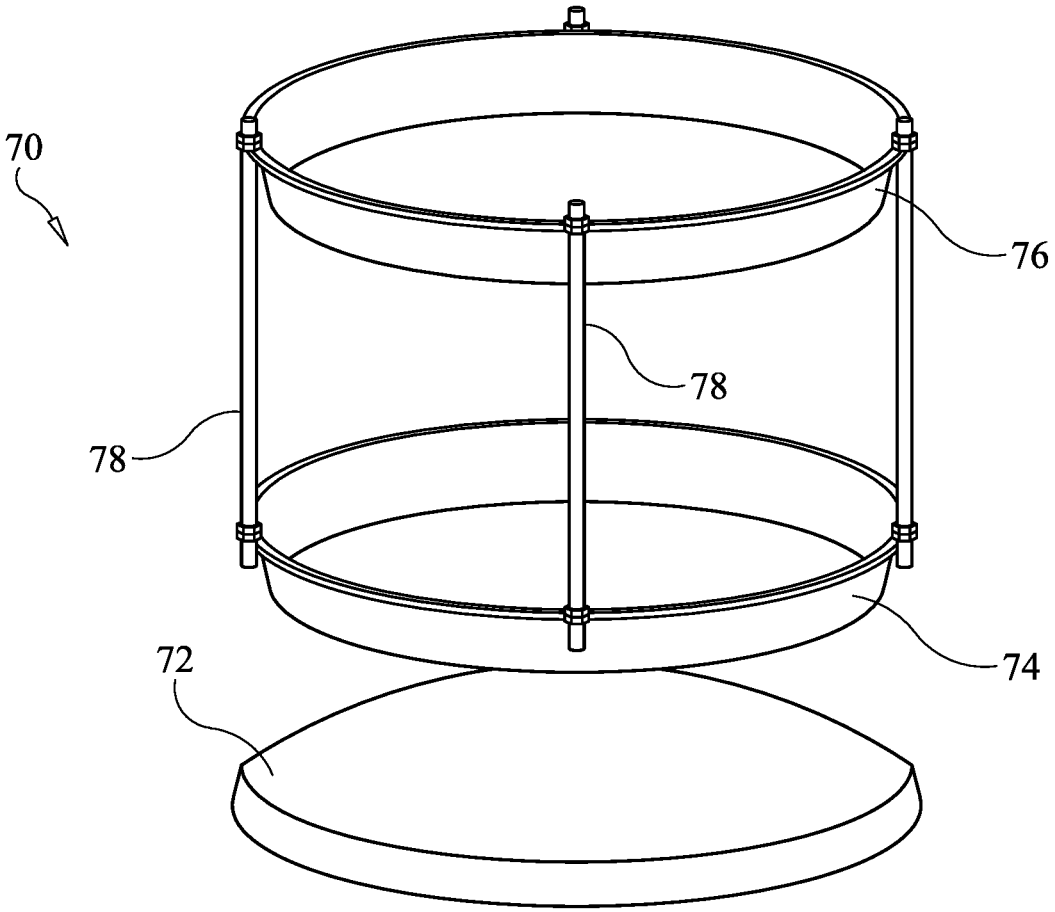
FIG. 5 is a perspective view of a lid for the open top of the burner in accordance with another embodiment of the present invention.

In another embodiment of the present invention, a lid for can 20 could include multiple open-top receptacles. For example, FIG. 5 illustrates a lid 70 that includes a can covering portion 72, a first open-top receptacle 74, and a second open-top receptacle 76 positioned above and coupled to receptacle 74 by supports 78. Receptacles 74 and 76 can be used in a variety of ways to include feeding/watering for birds, planting, and/or other decorative ways without departing from the scope of the present invention.

Figure 6:
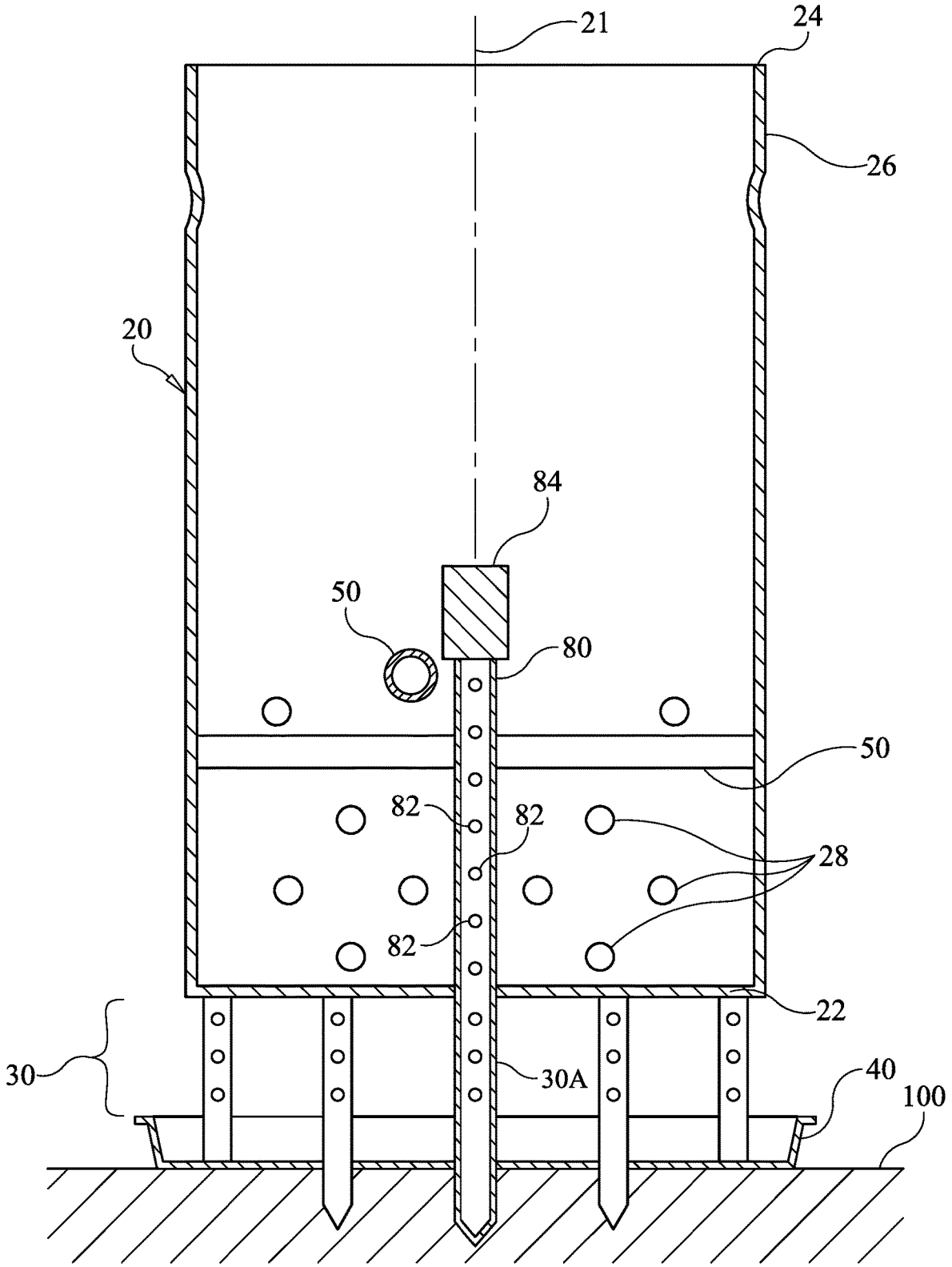
FIG. 6 is a cross-sectional view of a burner illustrating the inclusion of a drive rod in accordance with another embodiment of the present invention.

As explained above, the burner of the present invention is held in place at a ground surface by its longer legs 30A in cooperation with tray 40 and a ground region. While it may be possible for a user to press down on open top 24 to drive longer legs 30A into a ground region, this may be difficult when a ground region comprises hard or compacted soils. Accordingly, the present invention can include a drive rod in can 20 that supports the use of a hammer or mallet to install the burner in a ground region. This additional feature is illustrated in FIG. 6 where one of longer legs 30A is aligned with the central longitudinal axis 21 of can 20. A drive rod 80 (e.g., a solid rod, a hollow rod as shown, etc.) is coupled to bottom 22 of can 20 and extends upward into can 20 along its axis 21. If rod 80 is hollow as shown, the interior of rod 80 can be in fluid communication with the interior of its aligned longer leg 30A, and rod 80 can include perforations 82 to allow ambient air flowing into longer leg 30A to enter into can 20 along the length of rod 80. The alignment of rod 80 with the centrally-positioned longer leg 30A allows a user to readily drive longer legs 30A into a ground region by hammering down on a drive head or cap 84 affixed to the top of rod 80.

The advantages of the present invention are numerous. The burner provides a voluminous amount of circulating ambient air into a burn zone to promote quick and clean burning of a variety of yard debris and/or papers/documents. The burner is readily installed in a ground location. The raised can increases air circulation and also allows ash to fall safely onto the burner's nonflammable tray. Lids for the burner provide additional utility and/or decorative possibilities thereby increasing the burner's value even when not used for burn activities.

Although the invention has been described relative to a specific embodiment thereof, there are numerous variations and modifications that will be readily apparent to those skilled in the art in light of the above teachings. It is therefore to be understood that, within the scope of the appended claims, the invention may be practiced other than as specifically described.

What is claimed as new and desired to be secured by Letters Patent of the United States is:

1. A nonflammable burner, comprising:

a can having an open top, sidewalls, and a bottom, said can including holes in said sidewalls and said bottom;

a plurality of hollow legs coupled to said bottom of said can, each of said hollow legs having an open end in fluid communication with an interior of said can, each of said hollow legs including perforations for providing fluid communication with an interior of said hollow legs and adapted for providing fluid communication with an ambient environment;

a tray adapted to be positioned on a ground surface, said tray engaged with said plurality of hollow legs wherein said bottom of said can is spaced apart from said tray; and a plurality of open-ended conduits extending between said sidewalls of said can and providing a fluid flow path there through, each of said conduits adapted to admit the ambient environment therein, each of said conduits including perforations for providing fluid communication between said fluid flow path and said interior of said can.

2. A nonflammable burner as in claim 1, further comprising a lid for placement on said open top of said can, said lid including an open-top receptacle.

3. A nonflammable burner as in claim 1, further comprising a lid for placement on said open top of said can, said lid including a plurality of spaced-apart open-top receptacles.

4. A nonflammable burner as in claim 1, wherein said bottom of said can is approximately parallel to said tray.

5. A nonflammable burner as in claim 1, wherein a portion of said hollow legs pass through said tray, and wherein a remainder of said hollow legs rest on said tray.

6. A nonflammable burner as in claim 5, wherein each hollow leg from said portion of said hollow legs passing through said tray terminates in a spike.

7. A nonflammable burner as in claim 5, wherein one of said hollow legs from said portion thereof is aligned with a central longitudinal axis of said can, and wherein said nonflammable burner further comprises a rod coupled to said bottom of said can and extending into said interior of said can along said central longitudinal axis thereof.

8. A nonflammable burner as in claim 1, wherein said can comprises a metal trash can.

9. A nonflammable burner as in claim 8, further comprising a plurality of metal trash can lids connected together for closing off said open top of said can and for providing at least one open-top receptacle.

10. A nonflammable burner, comprising:

a can having an open top, sidewalls, and a bottom, said can including holes in said sidewalls and said bottom;

a plurality of hollow legs coupled to said bottom of said can, each of said hollow legs having an open end in fluid communication with an interior of said can, each of said hollow legs including perforations for providing fluid communication with an interior of said hollow legs and adapted for providing fluid communication with an ambient environment, wherein a portion of said hollow legs have a first length and a remainder of said hollow legs have a second length wherein said first length is greater than said second length;

a tray adapted to be positioned on a ground surface, said tray engaged with said plurality of hollow legs wherein said portion of said hollow legs pass through said tray and said remainder of said hollow legs rest on said tray wherein said bottom of said can is spaced apart from said tray by a distance equal to said second length; and a plurality of open-ended conduits extending between said sidewalls of said can and providing a fluid flow path there through, each of said conduits adapted to admit the ambient environment therein, each of said conduits having perforations for providing fluid communication between said fluid flow path and said interior of said can.

11. A nonflammable burner as in claim 10, further comprising a lid for placement on said open top of said can, said lid including an open-top receptacle.

12. A nonflammable burner as in claim 10, further comprising a lid for placement on said open top of said can, said lid including a plurality of spaced-apart open-top receptacles.

13. A nonflammable burner as in claim 10, further comprising a spike coupled to each of said hollow legs from said portion thereof.

14. A nonflammable burner as in claim 10, wherein one of said hollow legs from said portion thereof is aligned with a central longitudinal axis of said can, and wherein said nonflammable burner further comprises a rod coupled to said bottom of said can and extending into said interior of said can along said central longitudinal axis thereof.

15. A nonflammable burner as in claim 10, wherein said can comprises a metal trash can.

16. A nonflammable burner as in claim 15, further comprising a plurality of metal trash can lids connected together for closing off said open top of said can and for providing at least one open-top receptacle.

17. A nonflammable burner, comprising:

a can having an open top, sidewalls, and a bottom, said can including holes in said sidewalls of a lower half of said can and said bottom;

a plurality of hollow legs coupled to said bottom of said can, each of said hollow legs having an open end in fluid communication with an interior of said can, each of said hollow legs including perforations for providing fluid communication with an interior of said hollow legs and adapted for providing fluid communication with an ambient environment;

a tray adapted to be positioned on a ground surface, said tray engaged with said plurality of hollow legs wherein said bottom of said can is spaced apart from said tray; and a plurality of conduits extending between a portion of said holes in said sidewalls of said can, each of said conduits including two open ends adapted to be in fluid communication with the ambient environment wherein a flow path extends through each of said conduits, each of said conduits positioned at a unique height in said can, each of said conduits including perforations for providing fluid communication between said fluid flow path and said interior of said can.

18. A nonflammable burner as in claim 17, further comprising a lid for placement on said open top of said can, said lid including an open-top receptacle.

19. A nonflammable burner as in claim 17, further comprising a lid for placement on said open top of said can, said lid including a plurality of spaced-apart open-top receptacles.

20. A nonflammable burner as in claim 17, wherein said bottom of said can is approximately parallel to said tray.

21. A nonflammable burner as in claim 17, wherein a portion of said hollow legs pass through said tray, and wherein a remainder of said hollow legs rest on said tray.

22. A nonflammable burner as in claim 21, wherein each hollow leg from said portion of said hollow legs passing through said tray terminates in a spike.

23. A nonflammable burner as in claim 22, wherein one of said hollow legs from said portion thereof is aligned with a central longitudinal axis of said can, and wherein said nonflammable burner further comprises a rod coupled to said bottom of said can and extending into said interior of said can along said central longitudinal axis thereof.

24. A nonflammable burner as in claim 17, wherein said can comprises a metal trash can.

25. A nonflammable burner as in claim 24, further comprising a plurality of metal trash can lids connected together for closing off said open top of said can and for providing at least one open-top receptacle.

* * * * *